United States Patent [19]

Johnson et al.

[11] 4,411,313

[45] Oct. 25, 1983

[54] PUMP

[75] Inventors: J. Wallace Johnson, New Caney; A. B. M. Abdul Hye, Kingwood, both of Tex.

[73] Assignee: Liquid Level Lectronics, Inc., Houston, Tex.

[21] Appl. No.: 312,509

[22] Filed: Oct. 19, 1981

[51] Int. Cl.[3] ..... E21B 43/00

[52] U.S. Cl. ..... 166/90; 166/105; 166/68.5; 417/426; 417/554; 74/41

[58] Field of Search ..... 166/371, 68.5, 105, 166/90; 417/569, 554, 426; 74/41, 110, 108

[56] References Cited

U.S. PATENT DOCUMENTS 583,471 6/1897 Harrison ..... 417/569

1,539,459 5/1925 Blakely ..... 166/68.5

1,737,248 11/1929 Kelley ..... 166/68.5

2,730,957 1/1956 Riede ..... 417/569

3,247,798 4/1966 Glasgow et al. ..... 166/68.5

3,380,531 4/1968 McAuliffe et al. ..... 166/371

*Primary Examiner*—William F. Pate, III

*Assistant Examiner*—Hoang C. Dang

*Attorney, Agent, or Firm*—Robert W. B. Dickerson

[57] ABSTRACT

A pump, for injecting chemicals into a well, comprising a pivot arm for synchronous movement with a well pump. The pivot arm causes reciprocation of a plunger within the body of the chemical pump. The plunger, during its upward stroke causes the entry of chemicals from an outside source into the pump body and, during its downward stroke causes the exiting of the chemicals into the well.

2 Claims, 5 Drawing Figures

PUMP

BACKGROUND OF THE INVENTION

During this period of energy shortage, chemical means are commonly used to increase the flow of hydrocarbons from a production well. Such chemicals are normally pumped down a well to reduce the resistance of flow from the surrounding strata into the well. Various chemical pumps or injectors have been devised, including some for use with a "walking beam" type production pump. Such prior devices have not only been bulky, but have required placement in inconvenient locations. The pump of this invention is not only compact and efficient, but may be positioned in any number of locations of convenience.

SUMMARY OF THE INVENTION

An actuator beam is pivotally joined to the walking beam of a production pump. Said actuator beam pivots about a fixed pivot joint and one end of the actuator beam causes reciprocation of a plunger rod within the chemical pump body. An outside chemical source would make treating chemicals available at the pump inlet. The upward plunger stroke creates a partial vacuum within the pump body and draws chemicals therein. The downward stroke forces such chemicals out the pump exit, against the force of a spring biased ball check valve, through a conduit into a well. The linkage between the actuator beam and the pump housing is such that while relative vertical movement between the actuator beam pivot point and the housing is restricted, there may be relative rotational movement.

DESCRIPTION OF A PREFERRED EMBODIMENT

Figure 1:
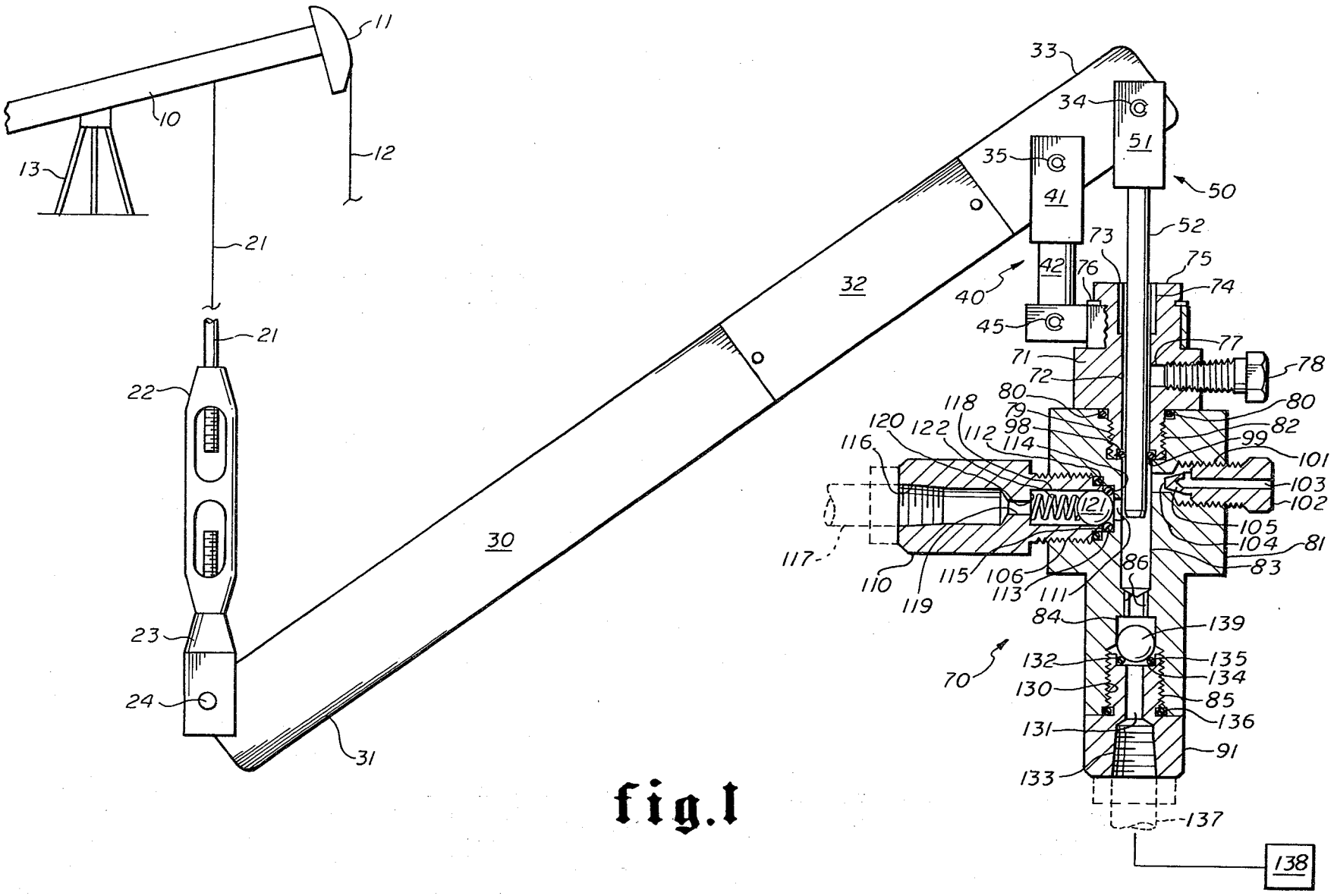
FIG. 1 is a partially schematic, vertical section through the pump housing, with the connection between the housing and walking beam shown in elevation.

Looking first at FIG. 1, a reciprocating (or actually oscillating) walking beam of a production pump is generally illustrated at 10. Such beam may have horse head 11 at the end thereof, to accomodate cable 12 for normal production purposes. Intermediate support 13 and the horse head, flexible pump cable 21 would downwardly depend for reciprocation along with the walking beam. The lower end of cable 21 would be fixed to an adjustment means such as turnbuckle 22. Such turnbuckle would permit adjusting the stroke of the pump hereinafter described. The lower end of member 22 includes a depending clevis 23, which, by virtue of pivot pin 24, pivotally joins the clevis, and thereby the turnbuckle, to one end 31 of actuator beam 30, said pin passing through an aperture (not shown) in said one end of beam 30. Said beam may include a name plate 32 centrally thereof.

Figure 3:
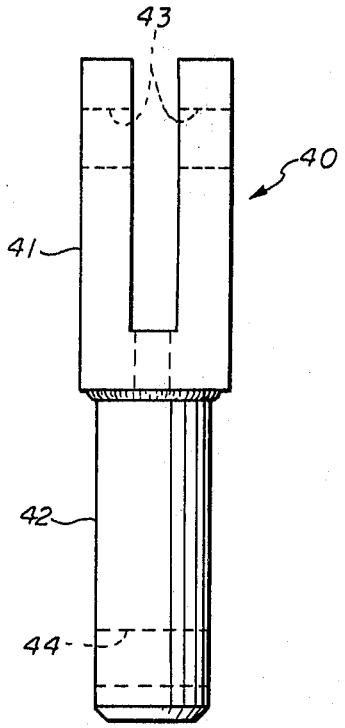
FIG. 3 is a side elevation of the connecting rod.

The other end 33 of beam 30 includes a pair of spaced apertures (also not specifically shown) for the passage therethrough of pivot pins 34 and 35. Such pins would pivotally link connecting rod 40 and plunger assembly 50 to said other beam end 33. Connecting rod 40 is more clearly shown in FIG. 3 and includes a clevis 41 having a cylindrical nipple or lug 42 depending therefrom. Legs of the clevis include aligned apertures 43 therethrough to accommodate pin 35. Member 42 is also apertured at 44 to permit passage therethrough of pivot pin 45.

Figure 2:
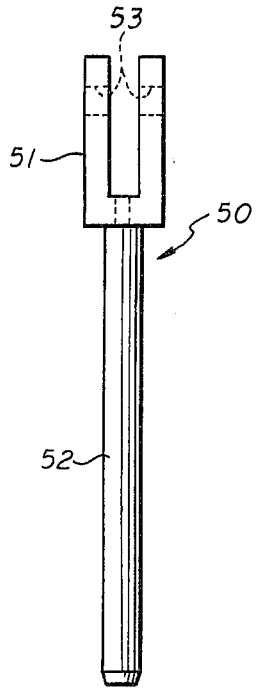
FIG. 2 is a side elevation of the plunger assembly.

Plunger assembly 50 (see FIG. 2) also includes a clevis 51 and has a rather extended cylindrical plunger rod 52 depending therefrom. The legs of clevis 51 also possess aligned apertures 53 therethrough, to accommodate pivot pin 34.

Figure 4A:
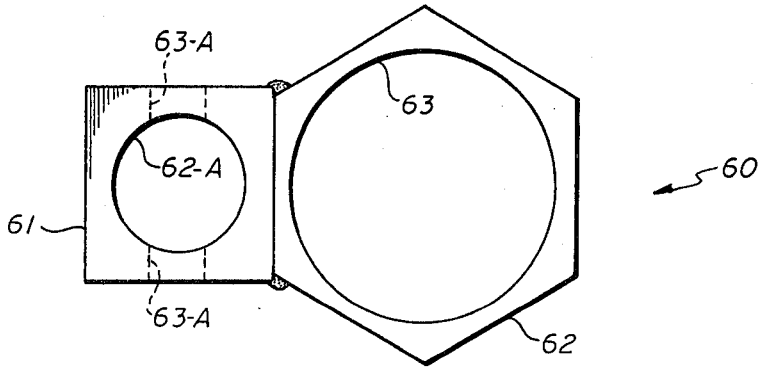
FIGS. 4-A and 4-B are, respectively, plan and side elevations of the actuator assembly.
Figure 4B:
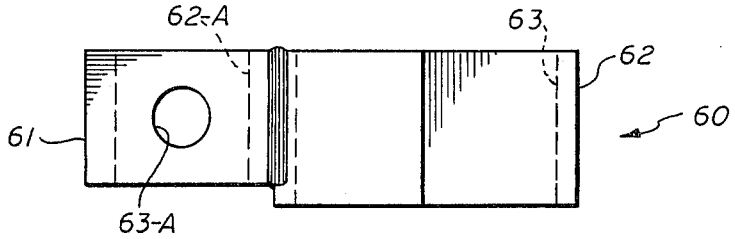

The lower end of connecting rod nipple 42 is pinned to yoke 61 of actuator assembly 60 (See FIGS. 4-A, 4-B). This block like yoke includes central axial bore 62-A to accomodate said lower end 42 of the connecting rod. Yoke 61 also includes aligned lateral bores 63-A to permit linkage by pin 45 of the connecting rod and yoke. Yoke 61 is fixed, as by welding, to slip ring 62. This ring includes large diameter axial bore 63 therethrough, to permit rotatable accomodation by a part of the pump body, hereinafter described.

Consider now the pump body 70 itself (see FIG. 1). It includes a generally 3-part housing, namely upper packing block assembly 71, intermediate central body 81 and lower body 91. The packing block assembly 71 is axially bored therethrough at 72 to reciprocatingly receive plunger rod 52. Bushing 73 may be positioned within counter bore 74 in cylindrical nipple 75 at the upper end of the packing block assembly. Retainer ring 76 would bar relative vertical movement between slip ring 62 of actuator assembly 60 and the pump body, while permitting relative rotational movement. Below nipple 75, the packing block assembly includes a lateral lubricating bore 77, in communication with axial bore 72, which lubricating bore is removably blocked by threaded lug 78. Opposite nipple 75, threaded lug 79 is engaged with internally threaded counterbore 82 of central body 81. Seal 80, which may be of the VITON O-ring type would prevent leakage between members 71 and 81. Lug 79 also includes counterbore 98 at its lower end, into which is positioned packing 99, for dynamic sealing with plunger rod 52.

Central body 81 also includes aligned axial bores 83 and 84 and internally threaded lower counterbore 85. Bore 83 forms a central fluid reservoir. Bores 84, 85 are in open communication, while bores 83, 84 communicate via a pair of spaced fluid passageways 86. The central body 81 also includes lateral air exhaust port 101, in communication with central bore 83, into which bleed screw 102 may threadedly be engaged. Screw 102 includes air passageway 103 which opens near its unthreaded end 104. Shoulders near such unthreaded end may sealingly engage seats 105 in the wall of port 101 to releaseably block air escape through passageway 103.

Central body 81 further includes internally threaded discharge port 106 to receive exteriorly threaded discharge check valve body 110. Lateral aperture 111 communicates between axial bore 83 and check valve body 110. O-ring seal 112 is shown positioned between adjacent shoulders of members 81 and 110 to prevent leakage therebetween. Additionally, a combination sealing and valve-seating O-ring 113 is positioned intermediate shoulder 114 of central body 81 and end 115 of check valve body 110.

Axially of said valve body 110, internally threaded discharge port 116 would be connected, such as by conduit 117, to a production well (not shown). Such discharge port is in fluid communication with check valve bore 118, through intermediate, reduced-diameter, counter bore 119, a shoulder 120 being formed intermediate bore sections 118, 119. Positioned within bore 118, is ball 121 biased toward seal-seat 114 by spring 122, which spring seats against both ball 121 and shoulder 120.

Lower body portion 91 includes externally threaded nipple 130 to engage threaded bore portion 85 of the central body 81. Member 91 also includes central axial bore 131, enlarged counter bore 132, and enlarged, internally threaded counter bore 133, forming a chemical inlet port. An annular shoulder 134 is formed at the juncture of port sections 131, 132, at which combination O-ring seal-seat 135 is positioned. Ball 139 is movably positioned within bore portion 84 of body 81, and may removably seat against seal-seat 135. O-ring seal 136 would prevent leakage between members 81, 91. Chemical conduit 137 would provide chemicals from generally indicated chemical source 138 to inlet port 133.

Consider now the operation of the device. As the walking beam reciprocates, cable 21, turnbuckle, clevis 23 and one end 31 of beam 30 move therewith. Connecting rod 40 is fixed at its lower end by pin 45 to actuator assembly 60. By virtue of the rotatably-sliding engagement between the actuator assembly and the upper packing block assembly 71 portion of the pump body, such pump body may be fixed to the platform at almost any convenient location. This feature represents a substantial improvement over the prior art. As the walking beam moves downwardly, end 33 of beam 30 moves upward about pivot pin 35 (which is fixed relative to the pump housing). Such upward movement creates a vacuum within bore 83, permitting ball 139 to be lifted off its seat 135 by chemicals from source 138, such chemicals then passing through passageways 86 into bore 83, and filling lateral aperture 111. When the walking beam moves upwardly, plunger rod moves down, the force of compression on the chemicals in bore 83 causes ball 139 to seat, causes ball 121 to unseat against the force of spring 122, and provides a surge of chemicals to pass through conduit 117 to the well.

At start up, bleed screw 102 would be loosened so as to remove it from seat 105 for air within bore 83 to be exhausted. When chemicals jet from air passageway 103, the screw may be tightened so as to seal such passageway.

Although only a single embodiment has been described, it should be obvious that numerous modifications would be possible by one skilled in the art without departing from the spirit of the invention, the scope of which is limited only by the following claims.

We claim:

1. A device for pumping production enhancing fluids from a fluid source into a well, said device comprising:

housing member having a bore therein forming a fluid reservoir and a fluid entry and a fluid exit port;

plunger means reciprocatingly insertable into one end of said bore;

means for providing production enhancing fluid from a fluid source to said fluid entry port;

means for evacuating said production enhancing fluid from said bore through said exit port, whereby said evacuated fluid subsequently enters said well;

both said means for providing and evacuating said fluid include said plunger means; and means linking said housing member and said plunger means to a reciprocatable member of a production pump, said linking means comprising;

(1) connector member pivotally connected, near one end, to cable means, said cable means being connected to and reciprocating with said reciprocatable member of said production pump, said connector member also being pivotally connected to one end of said plunger means, and (2) connecting rod pivoted at one end to said connector member intermediate said connector member's connections with said cable means and said plunger means said connecting rod being secured to said housing member by yoke means, said yoke means including an apertured portion permitting free relative rotation between said housing member and said yoke means; and (3) means preventing relative axial movement between said housing member and said yoke means.

2. The device of claim 1 and including: means for permitting the exhaust of gas from said housing bore, said exhaust permitting means comprising an apertured screw removably insertable within a threaded exhaust port through a wall of said housing member, said exhaust port including shoulder means for releasably blocking the flow of gas through said screw aperture.

* * * * *